US010605043B2

(12) United States Patent
Zbranek et al.

(10) Patent No.: US 10,605,043 B2
(45) Date of Patent: Mar. 31, 2020

(54) DEGRADABLE PUMP IN SHOE

(71) Applicant: ConocoPhillips Company, Houston, TX (US)

(72) Inventors: Zachary L. Zbranek, Rosenberg, TX (US); Charles Colpitt, Houston, TX (US); James G Nanney, Midland, TX (US); Matthew L. White, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/680,986

(22) Filed: Aug. 18, 2017

(65) Prior Publication Data

US 2018/0051533 A1 Feb. 22, 2018

Related U.S. Application Data

(60) Provisional application No. 62/376,734, filed on Aug. 18, 2016.

(51) Int. Cl.

| | |
|---|---|
| ***E21B 33/13*** | (2006.01) |
| ***E21B 33/12*** | (2006.01) |
| ***E21B 33/134*** | (2006.01) |
| ***E21B 33/16*** | (2006.01) |
| ***E21B 17/14*** | (2006.01) |

(52) U.S. Cl.
CPC ..... *E21B 33/134* (2013.01); *E21B 17/14* (2013.01); *E21B 33/16* (2013.01)

(58) Field of Classification Search
CPC ..... C04B 28/02; C04B 40/0092; E21B 33/12; E21B 33/13; E21B 33/138; E21B 33/14
See application file for complete search history.

(56) References Cited

U.S. PATENT DOCUMENTS

| | | | | |
|---|---|---|---|---|
| 4,175,619 | A | 11/1979 | Davis | |
| 5,181,571 | A * | 1/1993 | Mueller | E21B 7/04 166/381 |
| 5,890,537 | A | 4/1999 | Lavaure et al. | |
| 6,561,270 | B1 | 5/2003 | Budde | |
| 7,472,753 | B2 | 1/2009 | Mondelli et al. | |
| 9,279,295 | B2 | 3/2016 | Williamson et al. | |
| 2009/0255686 | A1 * | 10/2009 | Richard | E21B 37/06 166/376 |
| 2011/0203795 | A1 * | 8/2011 | Murphy | C09K 8/42 166/292 |
| 2012/0181033 | A1 | 7/2012 | Saini et al. | |

(Continued)

FOREIGN PATENT DOCUMENTS

| | | | |
|---|---|---|---|
| WO | 2016025682 | A1 | 2/2016 |
| WO | 2016032619 | A1 | 3/2016 |

OTHER PUBLICATIONS

International Search Report, PCT/US2017/047634, dated Dec. 29, 2017; 3 pgs.

*Primary Examiner* — Zakiya W Bates

(74) *Attorney, Agent, or Firm* — Polsinelli PC

(57) ABSTRACT

By incorporating a dissolvable or degradable material into the wiper dart and/or float equipment, a fluid can be pumped during the cement phase (or spotted by other means) to begin degradation of the dissolvable material. Once the material is dissolved, a flow path is exposed, allowing communication to the backside or formation of the wellbore through the plug set and shoe track.

16 Claims, 5 Drawing Sheets

(56) References Cited

U.S. PATENT DOCUMENTS

| | | | | |
|---|---|---|---|---|
| 2013/0062063 | A1 | 3/2013 | Baihly et al. | |
| 2014/0116721 | A1 | 5/2014 | Hoffman et al. | |
| 2014/0190685 | A1 | 7/2014 | Frazier et al. | |
| 2015/0159462 | A1 | 6/2015 | Cutler | |
| 2015/0369040 | A1 | 12/2015 | George et al. | |
| 2016/0047199 | A1* | 2/2016 | Hardesty | E21B 33/1208 166/302 |
| 2016/0376869 | A1 | 12/2016 | Rochen et al. | |
| 2017/0175487 | A1 | 6/2017 | Marcin et al. | |

* cited by examiner

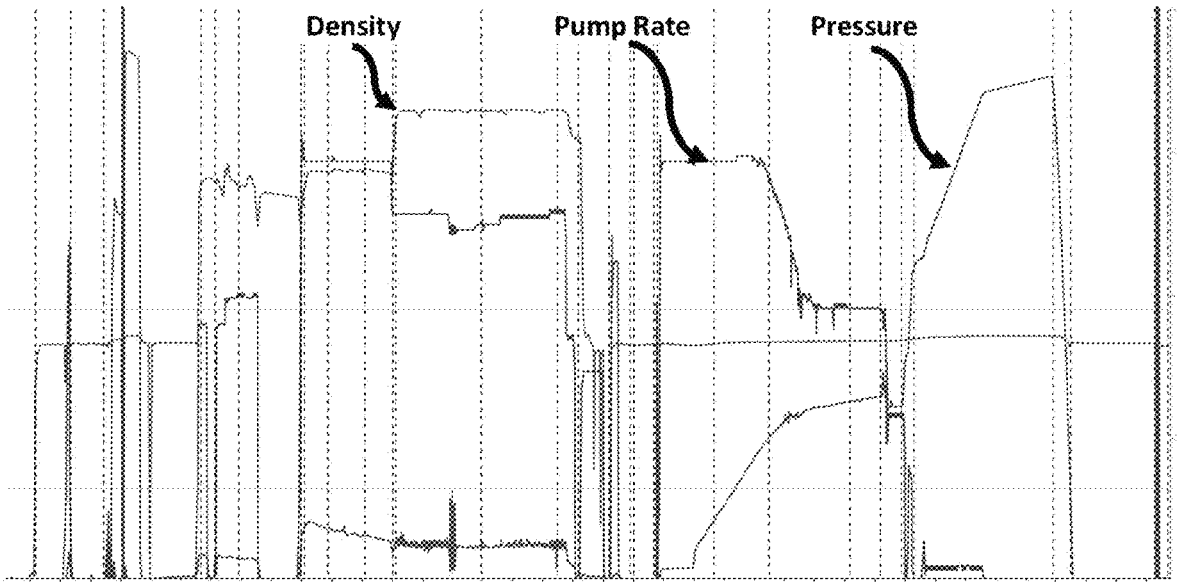
FIGURE 4A: Pressure Test
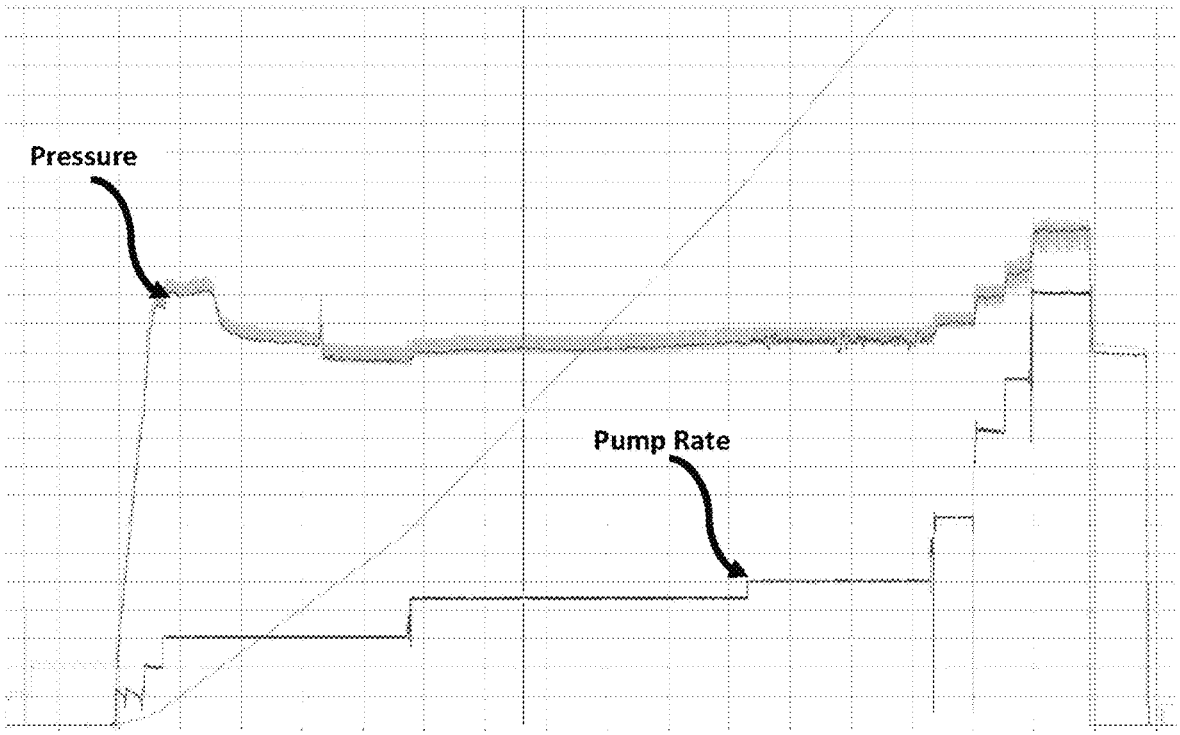
FIGURE 4B: Through Shoe

DEGRADABLE PUMP IN SHOE

CROSS-REFERENCE TO RELATED APPLICATIONS

This application is a non-provisional application which claims benefit under 35 USC § 119(e) to U.S. Provisional Application Ser. No. 62/376,734 filed Aug. 18, 2016, entitled "DEGRADABLE PUMP IN SHOE," which is incorporated herein in its entirety.

STATEMENT REGARDING FEDERALLY SPONSORED RESEARCH

None.

FIELD OF THE INVENTION

The present invention relates generally to cementing oil and gas production wells. More particularly, but not by way of limitation, embodiments of the present invention include tools and methods using a degradable pump-in shoe to reduce processing and improve performance while completing a hydrocarbon well.

BACKGROUND OF THE INVENTION

Oil and gas production has been developing rapidly over the last decade with the use of new technologies and materials. One advance has been the development of dissolvable materials for use during fracturing and other downhole procedures. The dissolvable ball when used with a sliding sleeve or ball seat allow fracturing, signaling, and pressure modulated processes to be conducted, then the ball dissolves allowing hydrocarbons to travel through the production well. Dissolvable materials require a known dissolution rate at bottom hole conditions including temperature, pressure, and solution.

Well completion occurs after the well has been drilled to depth. Completion, is the process of making a well ready for production. The bottom of the well is prepared according to required specifications including well bore casings, production casing, down hole tools, cementing, perforating, and stimulation as required. Once all equipment is delivered and the well cemented, the completion string integrity is tested prior to stimulation and/or production.

The most common completion practice is to cement the production casing and use shaped charge perforating guns to establish communication between the reservoir and the wellbore. A standard completion is depicted in FIG. 1 and contains a variety of commonly used tools in the 'shoe' of the well. Although different assemblies may be used dependent upon the well, casing diameter, production diameter, well bore, pressure, reservoir type and other factors, a typical well completion comprises running a production casing with shoe assembly through the surface casing/hole to the bottom of the well. Some common features include the cementing head 102, top pug, 110, bottom plug 112, float collar 114, centralizer 116, guide shoe 118. These are used with drilling fluid 108, displacement fluid 104, and cement slurry 106. A guide shoe 118 ensures the shoe assembly reaches depth without catching in the casing, well bore, and guides the shoe to the bottom of the hole past ledges and sidewall collapse, as the production casing passes through deviated sections of the well bore.

Centralizers 116 may be placed at intervals along the production casing to keep the production casing in the center of the well bore, ensure even distribution of the cement 120, and protect the production casing from wear on the side of the well bore and casing. A majority of wells completed today are horizontal wells and multiple centralizers are required to ensure the production casing does not rest on the bottom of the long, horizontal well bore.

A float collar serves many purposes during completion and can act as a final landing point for various types of equipment used during the completion process. The float collar provides a 'landing point' for the wiper plugs as well as any other equipment required at the shoe of the well. Equipment may include mechanical valves, backpressure valves, and the like. In some embodiments a separate shoe guide, centralizer, and float collar may be used. In other embodiments, a single piece my function as a guide shoe, centralizer and/or float collar to conserve space and minimize the length of shoe assembly.

Once the shoe assembly is in place, the well is cemented to protect and seal the wellbore. The cementing process involves careful calculation of the production casing and production casing annulus volumes, return volume, and amount of cement required to seal the annulus of the well. Typically after drilling, a wiper or bottom plug is placed in front of the cement slurry. The bottom plug has a diaphragm that bursts once the plug is seated on the float collar. The bottom plug may have a catch, that interlocks with the float collar to prevent movement of the wiper plug when it is seated. The bottom plug fills the inside diameter of the production casing and is typically made of a flexible material, such as rubber, plastic or other pliable material. The bottom plug may also have a metal or solid elastomeric body with flexible fins that 'wipe' the sides of the production casing. The bottom plug pushes any debris to the bottom of the well and reduces the amount of material stuck inside the production casing. The bottom plug is hollow and once the diaphragm bursts, the cement flows through the bottom plug, float collar, centralizers, and guide shoe into the annulus of the well bore.

A top plug 110 is run after the slug of cement. The top plug ensures the cement is pushed intact through the production casing, through the bottom plug, and into the annulus of the well. The top plug is typically solid and must resist large changes in pressure to ensure that the cement is pushed completely through the production casing, through the bottom plug, and through the check or backpressure valve. Once the top plug lands on the bottom plug, there is a dramatic increase in surface pressure signaling the end of the cementing procedure. The increase in pressure verifies the integrity of the production casing and confirms there is no leak-off of pressure. Because the top plug is a solid plug it completely blocks flow through shoe assembly. The cement sets in the shoe assembly and the well must be perforated to obtain fluid communication with the well bore. FIG. 1B shows a shoe assembly filled with cement after the cementing process. Lavaure, et al., (U.S. Pat. No. 5,890,537) describes a casing or liner cementing method including the steps of positioning lower and upper wiper plugs having elastomer cups.

Degradable materials have been used to create downhole tools previously. Fripp & Walton, (WO2016032619A1 & WO2016025682A1) describe downhole tools having at least one component made of a doped magnesium alloy solid solution that at least partially degrades in the presence of an electrolyte. Hoffman, et al., (US20140116721A1) describes closed toe required for pressure testing tubing installed in a well.

A wet shoe as described by Williamson & Stratton (U.S. Pat. No. 9,279,295) occurs when cement does not set around or obstruct the float valve or check valves at the end of the liner. If during cementing the float or check valves are obstructed, the guide shoe and toe of the well must be drilled out to obtain a wet shoe. A wet shoe enables subsequent operations after cementing including pumping plugs, perforating guns and other equipment to the toe of the well.

After the final production casing string for a well (Oil, Gas, and/or Water) is cemented, the production casing well becomes a closed loop system. In order to establish communication to the formation, perforations or hydraulic actuated toe-valves have to be deployed in order to establish a connection. What is required is a new shoe equipment cementing process that provides a tight cement seal for the production casing and shoe assembly but allows fluid communication with the backside of the well bore upon completion.

BRIEF SUMMARY OF THE DISCLOSURE

By incorporating a dissolvable or degradable material into the wiper dart and/or float equipment, a fluid can be pumped during the cement phase (or spotted by other means) to begin degradation of the dissolvable material. Once the material is dissolved, a flow path is exposed, allowing communication to the backside or formation of the wellbore through the plug set and shoe track. The design of this tool and methods of use must also allow testing of the shoe prior to dissolution of the tool.

The invention more particularly includes a degradable top plug with a hollow body; a degradable plug; and flexible fins.

A process for cementing a wellbore using a degradable top plug is described by placing a bottom plug with a low pressure diaphragm in the production casing; injecting cement; placing a top plug with a degradable plug in the production casing; injecting a wash solution; and degrading the degradable plug that provides a wet shoe where the production casing is in fluid communication with the reservoir after the degradable plug is degraded.

Additionally, A process for cementing hydrocarbon well using a degradable top plug is described by placing a bottom plug with a low pressure diaphragm in a production casing in a wellbore; injecting cement on top of the bottom plug in the production casing; placing a top plug with a degradable plug in the production casing. The top plug may include as shown in FIG. 2 an interlocking nose 208, a hollow body 206, a degradable plug 204, and an interlocking tail 202; injecting a wash solution on top of the top plug until the top plug is tightly sealed upon the bottom plug; and degrading the degradable plug providing a wet shoe where the production casing is in fluid communication with the wellbore after the degradable plug is degraded.

In one embodiment, the degradable top plug includes a plug made of a polymer, gelatin, paper, ceramic, plastic, metal, alloy or any combination of these materials that is degraded by wash solution at reservoir temperatures. The degradable plug may be an aluminum alloy.

The degradable plug may degrade within hours or days, including 8, 9, 10, 11, 12, 13, 14, 15, 16, 17, 18, 19, 20, 21, 22, 23, or 24 hours after the top plug is tightly sealed upon the bottom plug; or the top plug may degrade within 1, 2, 3, 4, 5, 6, or 7 days after the top plug is tightly sealed upon the bottom plug.

The degradable plug may be, as shown in FIG. 3, a sphere 302, bullet 304, cylinder 306, cone 308, disc 310, or stopper 312 shaped plug. Additionally, the degradable plug is retained by a spring 314, clip, o-ring 316, packing 318, or paste. The degradable plug may form a tight seal using an o-ring 316 or washer 320.

As used herein "well bore casing" is an optional casing that lines the well bore. It is the outer tubing that protects the well bore from the earth and earth from production fluids. The well bore casing typically runs from a hanger at the surface to the reservoir. Well bore casing may or may not be run along the length of the reservoir dependent upon reservoir conditions and well design.

As used herein "production casing" is the inner casing or tubing that is used to transport oil and gas along with other reservoir materials from the reservoir up to the surface. Prior to cementing the shoe, fluids including drilling fluids may be run through the production casing and return to the surface through the annulus between the production casing and the well bore casing. Inversely, and much less common, fluids may also be run through the annulus and return through the production casing. The terms production casing and production tubing are used interchangeably herein, but in the industry there are some differences between "tubing" and "casing" and those of skill in the art may have a variety of non-exclusive definitions. Tubing may be used to describe coiled tubing or pipes with smaller diameters. Casing may be used to describe pipe with larger diameters. The use of the term casing or tubing may also depend upon the number and types of casing and may be project specific.

As used herein a "guide shoe" is a tapered or bullet shaped nose cone that is attached to the end of the shoe assembly. The guide shoe is typically made of steel, has a similar outside diameter as the production casing and may be threaded onto the production casing. The guide shoe may have a plug or other material on the interior that can be removed or forced out once the shoe is seated at the bottom of the well bore. The guide shoe may have an integral check valve that prevents reverse flow.

As used herein a "wet shoe" is a cemented shoe that maintains fluid contact with the toe of the well through all float or check valves in the shoe of the well.

As used herein a "check valve" is a one-way valve that permits flow in one direction and prevents flow in the opposite direction. A check valve may be pressure rated for either forward flow, back pressure flow, or both. During completion the check valve allows drilling fluid, wash fluid, cement, and other fluids to flow through the shoe assembly but prevents backflow through the shoe and into the production casing. Check valves are used in a variety of industries and have a variety of applications for flow control and safety. There are numerous check valve types including flapper, ball, spring loaded ball, disc, split disc, diaphragm, and tilting disc check valves.

As used herein a "centralizer" is any mechanical device that keeps the casing from contacting the wellbore wall. A centralizer may be a spring-bow centralizer, a rigid-type centralizer, solid blade, spiral blade, roller-type, and the like. The centralizer may be fitted with scratchers or fins to open up the well bore surface and create turbidity during cementing.

As used herein a "landing collar" is a collar installed inside the production casing at the bottom of the casing string. The float collar may have interlocking ridges or catches that hold the bottom plug in place. A landing collar typically does not contain any additional valves or other equipment but is merely a restriction in the diameter of the production casing where a tool (ball or wiper plug) will bump, catch or land.

As used herein a "float collar" is a collar installed inside the production casing at the bottom of the casing string. The float collar may have interlocking ridges or catches that hold the bottom plug in place. The float collar may also have a check valve called a "float valve" that prevents back-flow. In many instances the float collar is a coupling or pipe section installed between the production casing and guide shoe. In other instances, the float collar may be part of a unitary guide shoe, centralizer and/or float collar.

As used herein a "wiper plug" is a plug that is either made out of a flexible material or is a solid body with flexible fins. The fins of the wiper plug are wider than the inside diameter of the production casing and when pumped through the production casing form a tight seal around the inside of the production casing. The flexible material may be an elastomer, plastic, rubber, synthetic rubber, hydrogenated nitrile butadiene rubber (HNBR), and the like. In one embodiment the wiper plug is a solid, molded flexible material. In another embodiment the wiper plug is an aluminum tube with a variety of features one or more fins on the exterior, a "nose" shaped to guide the wiper through the tubing, an interlocking end on the nose designed to fit into the float collar or an earlier wiper plug. Multiple plugs may be run dependent upon the number and type of well treatments.

A "bottom plug" is a wiper plug containing a hollow center and a diaphragm with a specific pressure rating. The bottom plug is floated between the drilling or wash fluid and the cement to keep the cement from separating and mixing with other fluids in the well. The diaphragm may be rated for different pressures dependent upon the well conditions and pressures. Typically, the bottom plug diaphragm is ruptured with a minor increase in pressure when the bottom plug hits the float collar. Bottom plug diaphragms may burst with pressures ranging from 200 PSI to 1000 PSI.

A "top plug" is a wiper plug designed to push the cement through any check valves in the shoe assembly. For this invention, the top plug should also have a hollow center, but will have a dissolvable or degradable plug located above the hollow center. It is essential for the top plug to be rated for much higher pressures and the dissolvable plug must be able to withstand pressures ranging from 3,500 to 8,000 PSI or greater. Top plug design and features will be more clearly described in the examples below.

As used herein, "dissolvable" or "degradable" may be used interchangeably. A dissolvable material is a material that is mixed into the liquid becoming a homogenous solution. A degradable material is a substance that is susceptible to chemical breakdown. A dissolvable or degradable material is any material that will degrade or dissolve in a reservoir solution whether it is an injected wash solution, production fluid, or other liquid that preferentially dissolves or degrades the plug located in the hollow center of the top plug. A dissolvable or degradable material may be a polymer, ceramic, plastic, metal, or alloy that has known properties and will not degrade or dissolve in the presence of cement but will degrade or dissolve in the presence of wash fluid, production fluid or the like. The degradable material may feature (but not limited to) a composite metal or plastic degradable base material. In one embodiment the degradable or dissolvable material is aluminum or an aluminum alloy with known dissolution properties in the wash fluid.

BRIEF DESCRIPTION OF THE DRAWINGS

A more complete understanding of the present invention and benefits thereof may be acquired by referring to the follow description taken in conjunction with the accompanying drawings in which:

FIG. 1 depicts a typical shoe assembly before and after cementing.

FIG. 4 depicts a plot of pressure and pump rate. FIG. 4A depicts the pressure test after the pump in shoe is seated; and FIG. 4B depicts pressure while pumping after the plug has dissolved.

DETAILED DESCRIPTION

Figure 1A:
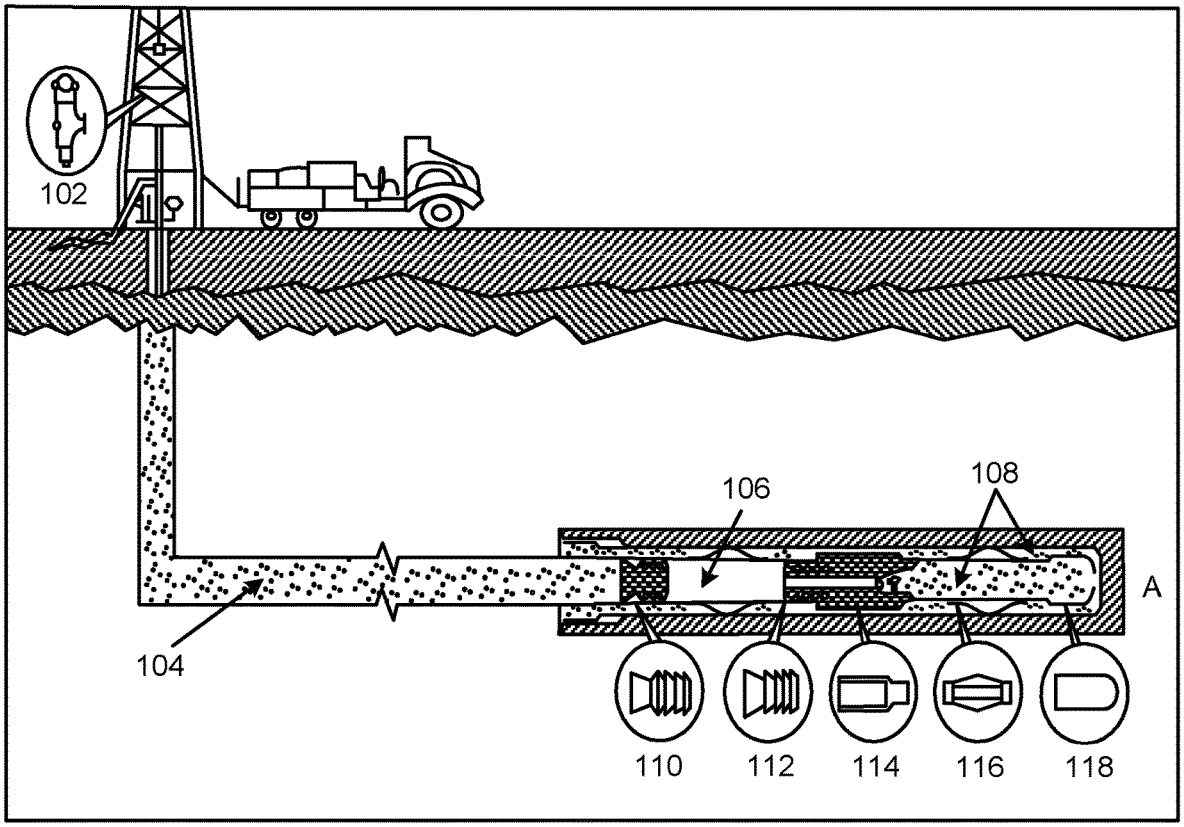
FIG. 1A (PRIOR ART)
FIG. 1A depicts the end of the well bore before cementing.
Figure 1B:
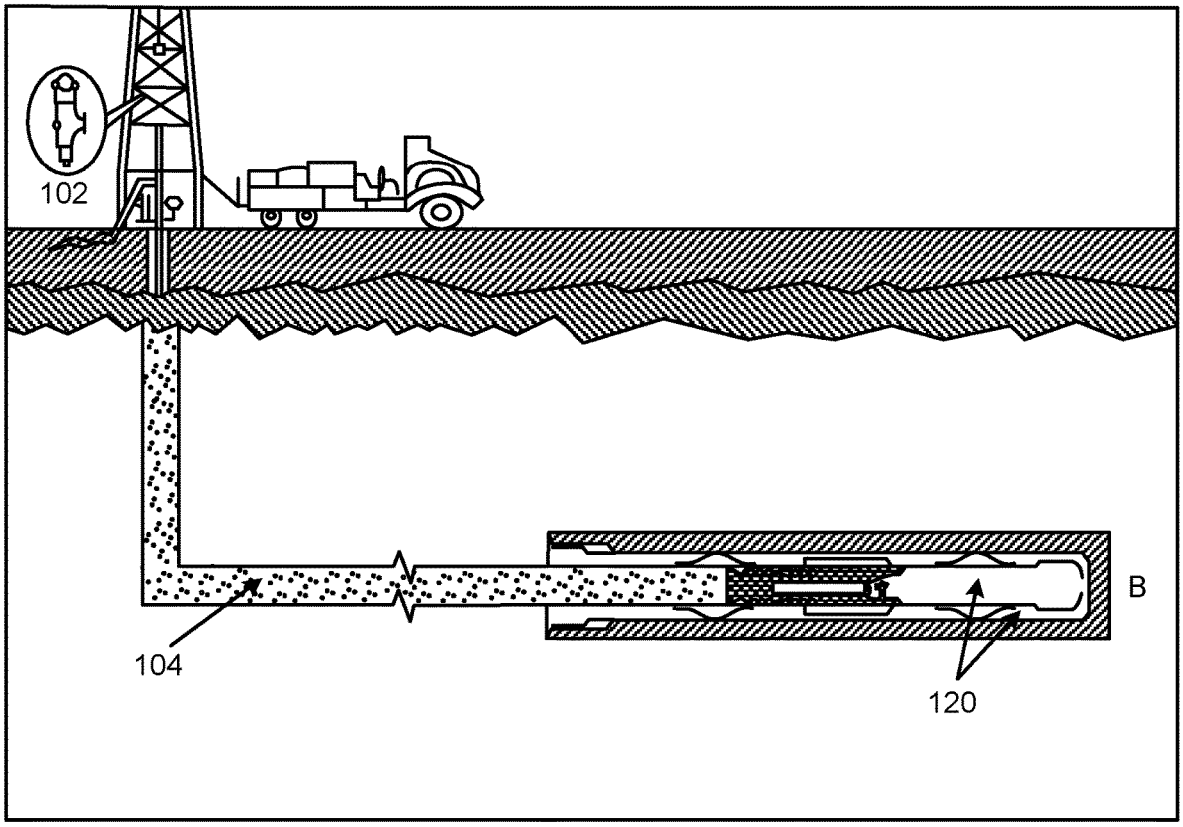
FIG. 1B (PRIOR ART)
FIG. 1B depicts the end of the well bore after cementing.
Figure 2:
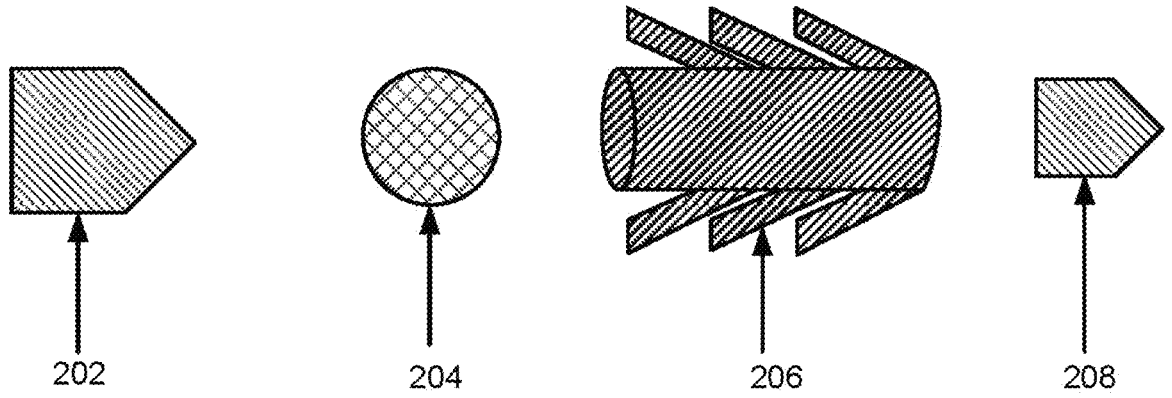
FIG. 2 depicts a top plug assembly with dissolvable plug.
Figure 3:
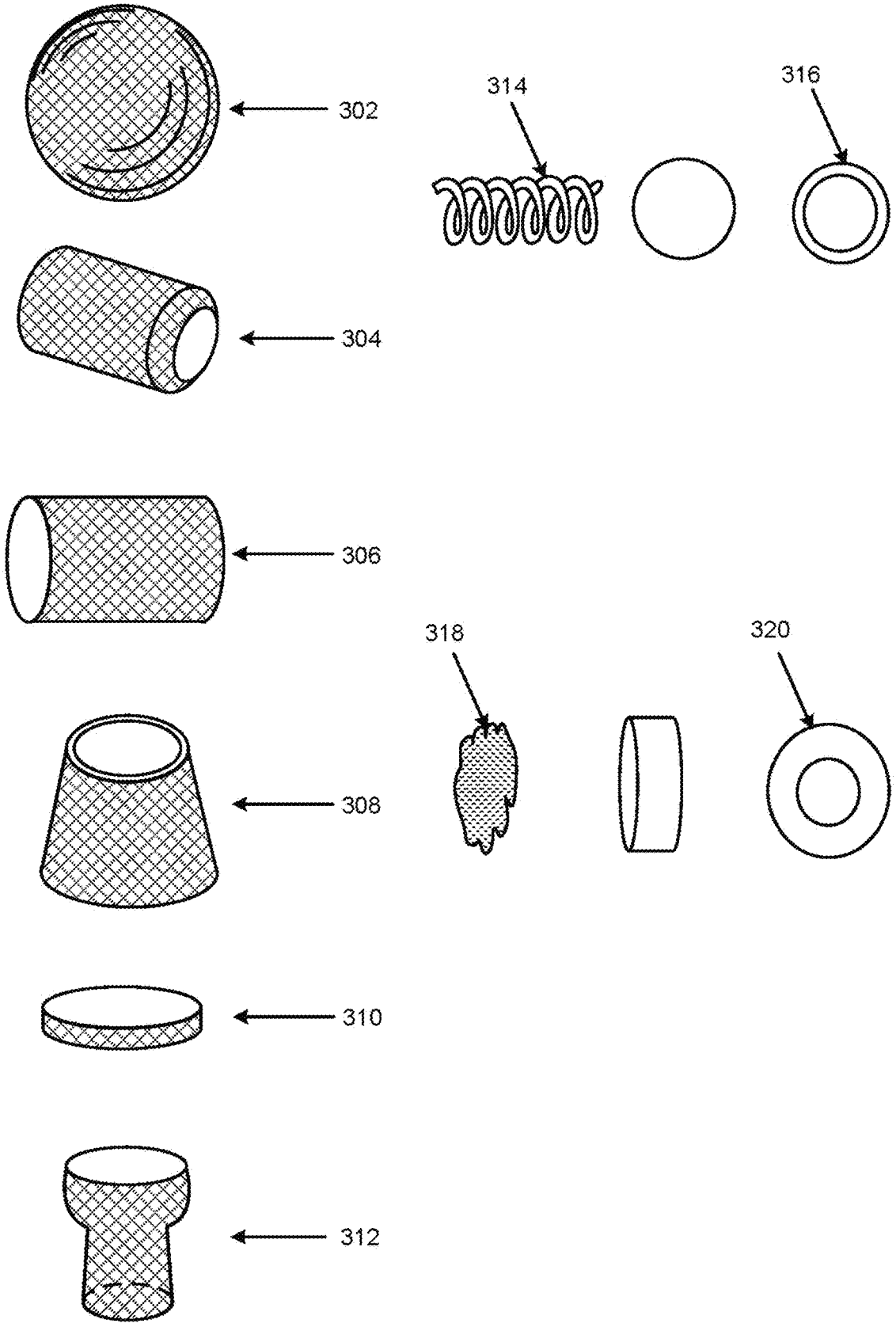
FIG. 3 depicts a variety of dissolvable plug designs

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

By incorporating a dissolvable or degradable material into the wiper dart and/or float equipment, a fluid can be pumped during the cement phase (or spotted by other means) to begin degradation of the dissolvable material. Once the material is dissolved, a flow path is exposed, allowing communication to the backside or formation of the wellbore through the plug set and shoe track. By incorporating a dissolvable or degradable material into the wiper dart and/or float equipment, the material will dissolve or degrade over time and will create a flow path, establishing communication to the backside. The material can either be made up in the float equipment and ran in the hole on casing or pumped down in the wiper dart(s). Once the plug lands at the landing collar (or PBTD-Plug back total depth) and is exposed to a fluid, the dissolvable or degradable material will begin to dissolve or degrade, allowing a flow path through the material.

The following examples of certain embodiments of the invention are given. Each example is provided by way of explanation of the invention, one of many embodiments of the invention, and the following examples should not be read to limit, or define, the scope of the invention.

EXAMPLE 1

A top plug is provided with a degradable plug mounted between the hollow body and the tail. The plug may be located anywhere in the hollow center of the top plug including a solid degradable nose cone, tail plug, mid-body plug, and the like. In one embodiment the plug is placed between the body and the tail while the tail is attached to the hollow body. In another embodiment the plug is placed between the body and the nose while the body is attached to the nose. The well is prewashed with after drilling is completed to remove debris and calculate volumes required for cementing. A bottom plug with a diaphragm is placed in the tubing. A slug of cement is injected behind the bottom plug, followed by the top plug containing the degradable plug, and finally a wash fluid is run behind the top plug. When the bottom plug connects with the landing or float collar a small increase in pressure may be observed before the diaphragm bursts due to a small differential in pressure. The small changes in pressure that may occur before the diaphragm bursts may or may not be visible at the surface dependent upon many factors including the reservoir conditions, cement, wash fluids, diaphragm strength, pump in pressure and rate, and other variables. Under some conditions, the landing of the bottom plug and bursting of the diaphragm is not observed. Once burst, the cement is pumped through the bottom plug until the top plug connects with the bottom plug. Pressure spikes and landing of the top plug is confirmed. The degradable plug begins deteriorating in the wash solution and will continue until it no long obstructs the flow path. Pressure tests may be run prior to degradation of the degradable plug. Flow may be reversed for a short period to confirm that the float collar or guide nose check valve is still intact and functioning. Pressure may be increased to confirm the integrity of the production casing. After a period of sufficient time which may be hours or days, the degradable plug deteriorates creating a "wet shoe" that allows fluid communication with the reservoir.

EXAMPLE 2

In another embodiment the body of top plug is made entirely out of a degradable aluminum alloy material that can be degraded by wash fluid under reservoir conditions. The degradable aluminum alloy body has elastomeric fins attached. The fins provide a tight seal with the production casing, but once the aluminum alloy degrades sufficiently, the fins will detach and flow separate from the aluminum body. The well is prewashed with an aqueous solution after drilling is completed to remove debris. A bottom plug with a diaphragm is placed in the tubing. A slug of cement is injected behind the bottom plug, followed by the degradable top plug, and finally a wash fluid is run behind the top plug. When the bottom plug connects with the interlocking float collar a small increase in pressure may be observed before the diaphragm bursts. Once burst, the cement pumped through the bottom plug until the top plug connects with the interlocking tail of the bottom plug. Pressure spikes and landing of the top plug is confirmed. The degradable plug begins deteriorating in the wash solution. Pressure tests may be run prior to degradation of the degradable top plug. Flow may be reversed for a short period to confirm that the float collar or guide nose check valve is still intact and functioning. Pressure may be increased to confirm the integrity of the production casing. After a period of sufficient time which may be hours or days, the degradable top plug deteriorates and flow through the float collar is restored providing a "wet shoe" that allows fluid communication with the reservoir.

EXAMPLE 3

In an additional embodiment the top plug is made entirely out of a flexible material that can be degraded by wash fluid under reservoir conditions. By forming a flexible top plug out of a degradable rubber, paper, or gelatin. The plug itself provides a tight seal with the production casing, but degrades at a slow enough rate to ensure separation of the cement from the wash fluid. The well is prewashed with an aqueous solution after drilling is completed to remove debris. A bottom plug with a diaphragm is placed in the tubing. A slug of cement is injected behind the bottom plug, followed by the degradable top plug, and finally a wash fluid is run behind the top plug. When the bottom plug connects with the interlocking float collar a small increase in pressure may be observed before the diaphragm bursts. Once burst, the cement pumped through the bottom plug until the top plug connects sets against the bottom plug. Pressure spikes when the top plug lands. The degradable plug begins deteriorating in the wash solution. Pressure tests may be run prior to degradation of the degradable top plug. Flow may be reversed for a short period to confirm that the float collar or guide nose check valve is still intact and functioning. Pressure may be increased to confirm the integrity of the production casing. After a period of sufficient time which may be hours or days, the degradable top plug deteriorates and flow through the float collar is restored providing a "wet shoe" that allows fluid communication with the reservoir.

EXAMPLE 4

In one embodiment, a dissolvable pump in shoe was delivered to the toe of the well. A pressure test was conducted on the production casing to 10,900 psi for 15 minutes immediately after bumping top cement plug with dissolvable plug insert as shown in FIG. 4A. Subsequently, 30 days after pressure testing the production casing, injection rate up to 15 bpm at 9,000 psi STP was established through the shoe track to prepare the well for multi stage fracture stimulation operations as shown in FIG. 4B. Thus using a dissolvable plug, the casing and cement could be pressure tested to ensure integrity. Then subsequent to dissolving the plug, the well could be treated for simulation through the dissolved plug.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 4,175,619, Davis, "Well collar or shoe and cementing"
2. U.S. Pat. No. 5,890,537, Lavaure, et al., "Wiper plug launching system for cementing casing and liners"
3. U.S. Pat. No. 9,279,295, Williamson & Stratton, "Liner flotation system"
4. US20140116721A1, Hofman, et al., "Downhole Tools, System and Method of Using"
5. US20150369040A1, George, et al., "Hydraulic Delay Toe Valve System and Method"
6. WO2016025682A1, Walton & Fripp, "DEGRADABLE WELLBORE ISOLATION DEVICES WITH VARYING FABRICATION METHODS"
7. WO2016032619A1, Fripp & Walton, "DEGRADABLE DOWNHOLE TOOLS COMPRISING MAGNESIUM ALLOYSα"

The invention claimed is:

1. A process for cementing a wellbore comprising:

placing a bottom plug with a low pressure diaphragm in a production casing;

injecting cement;

placing a top plug with a degradable plug in the production casing, wherein the top plug includes a hollow body having the degradable plug therein;

injecting a wash solution on top of the top plug until at least a portion of the top plug is sealed upon at least a portion of the bottom plug; and degrading the degradable plug, wherein a fluid flow path is formed through the hollow body of the top plug after the degradable plug is degraded, thereby establishing the production casing in fluid communication with a reservoir.

2. The process of claim 1, wherein the degradable plug is selected from a group comprising a polymer, gelatin, paper, ceramic, plastic, metal, alloys, or a combination thereof that is degraded by wash solution at reservoir temperatures.

3. The process of claim 1, wherein the degradable plug comprises an aluminum alloy.

4. The process of claim 1, wherein the degradable plug degrades within 24 hours after the top plug is tightly sealed upon the bottom plug.

5. The process of claim 1, wherein the degradable plug degrades within 7 days after the top plug is tightly sealed upon the bottom plug.

6. The process of claim 1, wherein the degradable plug is selected from a group comprising a sphere, bullet, cylinder, cone, disc, or stopper shaped plug.

7. The process of claim 1, wherein the degradable plug is retained by a retainer selected from a group comprising spring, clip, packing, or paste.

8. The process of claim 1, wherein the degradable plug has a tight seal formed by an o-ring or washer.

9. A process for cementing hydrocarbon well comprising:

placing a bottom plug with a low pressure diaphragm in a production casing in a wellbore;

injecting cement on top of the bottom plug in the production casing;

placing a top plug in the production casing, wherein the top plug comprises an interlocking nose, a hollow body, a degradable plug, and an interlocking tail;

injecting a wash solution on top of the top plug until the top plug is tightly sealed upon the bottom plug; and degrading the degradable plug, wherein the production casing is in fluid communication with the wellbore after the degradable plug is degraded.

10. The process of claim 9, wherein the degradable plug is selected from a group comprising a polymer, gelatin, paper, ceramic, plastic, metal, alloy, or a combination thereof that is degraded by wash solution at reservoir temperatures.

11. The process of claim 9, wherein the degradable plug comprises an aluminum alloy.

12. The process of claim 9, wherein the degradable plug degrades within 24 hours after the top plug is tightly sealed upon the bottom plug.

13. The process of claim 9, wherein the degradable plug degrades within 7 days after the top plug is tightly sealed upon the bottom plug.

14. The process of claim 9, wherein the degradable plug is selected from a group comprising a sphere, bullet, cylinder, cone, disc, or stopper shaped plug.

15. The process of claim 9, wherein the degradable plug is retained by a retainer selected from a group comprising spring, clip, packing, or paste.

16. The process of claim 9, wherein the degradable plug has a tight seal formed by an o-ring or washer.

* * * * *